US008444534B2

(12) United States Patent
McKee

(10) Patent No.: US 8,444,534 B2
(45) Date of Patent: May 21, 2013

(54) ROTATABLE HANDGRIP FOR A CARDIOVASCULAR EXERCISE MACHINE

(75) Inventor: Todd McKee, O'Fallon, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 0 days.

(21) Appl. No.: 12/167,924

(22) Filed: Jul. 3, 2008

(65) Prior Publication Data

US 2009/0011905 A1 Jan. 8, 2009

Related U.S. Application Data

(60) Provisional application No. 60/947,805, filed on Jul. 3, 2007.

(51) Int. Cl.
*A63B 69/16* (2006.01)
*A63B 22/00* (2006.01)

(52) U.S. Cl.
USPC ..... 482/57; 482/62

(58) Field of Classification Search
USPC ..... 482/51–53, 136–139, 62
See application file for complete search history.

(56) References Cited

U.S. PATENT DOCUMENTS

| | | | | |
|---|---|---|---|---|
| 3,721,438 | A * | 3/1973 | Kusmer | 482/56 |
| 4,743,018 | A * | 5/1988 | Eckler | 482/106 |
| 4,773,398 | A * | 9/1988 | Tatom | 601/34 |
| 4,951,956 | A * | 8/1990 | Vittone | 280/47.31 |
| 4,961,569 | A * | 10/1990 | Roberge | 482/62 |
| 5,265,307 | A * | 11/1993 | Hull et al. | 16/406 |
| 5,588,942 | A * | 12/1996 | Dillard | 482/139 |
| 5,916,065 | A * | 6/1999 | McBride et al. | 482/57 |
| 6,865,777 | B2 * | 3/2005 | Comstock | 16/114.1 |
| 7,108,636 | B1 * | 9/2006 | Garcia | 482/40 |
| 7,108,641 | B2 * | 9/2006 | Pertegaz-Esteban | 482/139 |
| 7,270,223 | B2 * | 9/2007 | Miller | 190/115 |
| 7,384,381 | B2 * | 6/2008 | Webber et al. | 482/100 |
| 7,874,961 | B2 * | 1/2011 | McKee et al. | 482/52 |
| 2005/0227824 | A1 * | 10/2005 | Wu et al. | 482/62 |

* cited by examiner

*Primary Examiner* — Stephen Crow
(74) *Attorney, Agent, or Firm* — Lewis, Rice & Fingersh, L.C.

(57) ABSTRACT

A rotatable handgrip for a cardiovascular exercise machine allowing a user to rotate the handgrip relative exercise arms of the machine about an axis which intersects the handle and is generally in line with their forearm.

12 Claims, 6 Drawing Sheets

ROTATABLE HANDGRIP FOR A CARDIOVASCULAR EXERCISE MACHINE

CROSS REFERENCE TO RELATED APPLICATIONS

This application claims the benefit of U.S. Provisional application Ser. No. 60/947,805, filed Jul. 3, 2007, the entire disclosure of which is incorporated herein by reference.

BACKGROUND OF THE INVENTION

1. Field of the Invention

The present invention generally relates to the field of cardiovascular machines. In particular, to handgrips on cardiovascular exercise machines which permit rotational movement of the wrist, hands, or arms during exercise.

2. Description of Related Art

The benefits of regular aerobic exercise on individuals of any age is well documented in fitness science, Aerobic exercise can dramatically improve cardiac stamina and function, as well as lead to weight loss, increased metabolism and other benefits. More of these benefits are reaped when a greater proportion of the body is active in aerobic exercise. This is because the body is generally more engaged, and users must be more balanced and coordinated. In addition, full-body aerobic exercise contributes to toning of the entire body rather than isolated portions.

The most common and accessible forms of aerobic exercise, namely running, walking, and bicycling, do not exercise participants' upper body or arms. To achieve the many benefits of full-body aerobic exercise, runners and walkers must concentrate on making exaggerated and often bizarre-looking movements to exercise their arms. Left to their own devices, such runners and walkers may engage in unsafe or ineffective movements or tire of the effort required and resort to only lower body movement. Bicyclists are generally completely without recourse for upper-body exercise.

A few stationary cardiovascular machines have attempted to address the problem of the absence of comfortable upper-body workouts in aerobic exercise. For example, on certain elliptical machines, a user uses a fairly natural motion to move their feet in a the smooth exercise pattern dictated by the machine, complemented by the user moving his or her arms in a reciprocating pumping type of motion while pulling or pushing various arms on the machine whose motion is connected to the motion of the feet, and vice-versa. Similar arms have also been combined with bicycling, in certain current models of stationary bicycles.

These arms fall short of providing an optimal full-body workout. Firstly, these arms guide the user to make only back-and-forth movements, without any rotational component of the wrist or arm. As such, only a very few muscle groups are activated, and the upper body workout does not burn as many calories or provide as many benefits as it could if it activated more muscle groups. In addition, the simple back-and-forth motion is considered boring by many users, and does not excite those users to optimize their workout. Current cardiovascular arms therefore do not present an engaging and stimulating full-body aerobic experience.

In addition, the back-and-forth motion provided by current cardiovascular machine arms is simply not ergonomic or comfortable for some users. The structure of the human forearm, wrist, and hand is such that arm-swinging is most natural and comfortable when the wrist rotates medially when the arm is extended in front of the exerciser. Current cardiovascular machine arms do not permit users to engage in this natural movement, and may even cause discomfort to some users. Because of the unnatural and potentially uncomfortable nature of current cardiovascular machine arms, many potential users forego the benefits of full-body aerobic exercise and do not use arms on present machines.

It is therefore desirable for cardiovascular machine arms to be structured such that the movement of those arms involves a rotational component, in order to increase the intensity of, interest in, and comfort of the workout provided, and thereby attract more users to the benefits of a full-body aerobic workout.

SUMMARY OF THE INVENTION

The following is a summary of the invention in order to provide a basic understanding of some of the aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems know to those of skill in the art, described herein, among other things, is a cardiovascular machine handgrip assembly comprising a shaft and a handle rotatably affixed to the shaft such that operation of the handgrip involves rotation of the handle, about an axis of rotation intersecting the shaft and intersecting the handle, in a plane perpendicular to the axis of rotation.

Also disclosed herein is a cardiovascular machine handgrip assembly comprising means for providing a handle at a comfortable and functional location relative to a user of the cardiovascular machine, and means for permitting the handle to rotate parallel to the providing means. Also disclosed is an embodiment in which the handle comprises a back wall, a side portion, and a grasping portion, wherein the back wall is rotatably affixed to the shaft by a pin that penetrates the back wall in the shaft. In a further embodiment, the permitting means comprises a pin for penetrating the handle and the providing means.

There is described herein, among other things, a rotatable handgrip assembly for a cardiovascular exercise machine outfitted with arms, the rotatable handgrip generally comprising: a shaft defining an axis of rotation and a handle where the shaft is attached to the arms of the cardiovascular exercise machine and where the handle is rotatably affixed to the shaft to rotate about the axis of rotation and where operation of the handgrip assembly involves rotation of the handle through a plane parallel to the shaft and where the axis of rotation intersects the handle.

In an embodiment of the rotatable handgrip assembly, the handle is adjustably affixed to the shaft.

In another embodiment of the rotatable handgrip assembly, the handle is located at a functional location relative to a user of the cardiovascular exercise machine.

In yet a still further embodiment rotatable handgrip assembly, the means for rotatably affixing the handle to the shaft is such that a user would encounter some resistance in causing the handle to swing.

In an embodiment of the rotatable handgrip assembly, the rotation of the handle is mechanically automated by the cardiovascular machine.

In yet another embodiment of the rotatable handgrip assembly, the handle comprises a back wall, a side portion; and a grasping portion and the back wall is rotatably affixed to the shaft.

In another embodiment of the rotatable handgrip assembly, the back wall of the handgrip is rotatably affixed to the shaft by a pin assembly.

In another embodiment of the rotatable handgrip assembly the pin penetrates the back wall of the handle and lodges within a hole on the shaft to secure the handle to the shaft.

In another embodiment of the rotatable handgrip assembly, the shaft has a plurality of holes such that the handle may be affixed to the shaft at any one of multiple heights.

In an embodiment of the rotatable handgrip assembly, the handle swings around the pin assembly to accommodate the natural twisting of a user's wrists.

Also described herein is a method of exercising a user's upper body on a cardiovascular exercise machine, the method comprising the user grasping the grasping portions of the handles attached to the arms of the cardiovascular exercise machine; the user moving the arms of the cardiovascular exercise machine in a back and forth motion in a plane parallel to the user's left and right sides and the user rotating the handles in a plane parallel to the shaft of the handgrip in a circular rotation around the point of attachment of the handle to the shaft such that the user may comfortably rotate his/her arm around an axis parallel to the user's forearm while exercising.

Also described herein is a cardiovascular exercise machine, the cardiovascular machine comprising footpads, arms, the bottoms of which are pivotably attached and interconnected to both the frame of the cardiovascular exercise machine and the footpads, and rotatable handgrips attached to the top of the arms where the cardiovascular machine provides for two axis of movement for a user's arms: the fore and aft motion dictated by the arms of the cardiovascular machine and the rotational movement of the handgrip along a horizontal axis parallel to the user's arm bones.

Also described herein is a rotatable handgrip for a cardiovascular exercise machine outfitted with at least one arm, the handgrip comprising: a pin defining an axis of rotation; and a handle; wherein the handle is rotatably affixed by the pin to one of the arms of the cardiovascular exercise machine; so as to rotate about the axis of rotation; wherein operation of the handgrip involves rotation of the handle in a plane generally perpendicular to the axis of rotation and wherein the axis of rotation intersects the handle.

In an embodiment of the rotatable handgrip the handle is adjustably affixed to the arm and may be located at a functional location relative to a user of the cardiovascular exercise machine.

In an embodiment of the rotatable handgrip rotation of the handle encounters resistance or is controlled by the cardiovascular machine.

In an embodiment of the rotatable handgrip the arm comprises an inner tube with holes, an outer tube, and a securing pin interconnecting the inner tube and the outer tube such that the height of the handle can be adjusted via the telescoping capabilities of the inner tube relative to aid outer tube.

In an embodiment, the rotatable handgrip further comprises: a back wall; and a side portion; wherein the back wall is rotatably affixed to the arm via the pin. The pin may penetrate the back wall of the handgrip and lodge within a hole on the arm to secure the handle to the arm. The arm may have a plurality of holes such that the handle may be affixed to the arm at any one of multiple heights. The handle may swing around the pin to accommodate the natural twisting of the user's wrists.

There is also described herein, is a method of exercising a user's upper body on a cardiovascular exercise machine, the method comprising: grasping handles rotatably attached to arms of the cardiovascular exercise machine; moving the arms of the cardiovascular exercise machine in a back and forth motion in a plane parallel to the user's left and right sides; rotating each of the handles relative to the arm above an axis generally parallel to a user's forearm and intersecting the associated handle.

There is also described herein a cardiovascular exercise machine comprising: a frame; at least two footpads; at least two arms, each of the arms being linked to the motion of one of the footpads when the machine is in motion; and a handle rotatably attached to each of the arms; wherein the arms move in a fore and aft motion relative to the cardiovascular machine; and wherein each of the handles rotates relative the attached arm about an axis intersecting the handle.

BRIEF DESCRIPTION OF THE DRAWINGS

FIG. 5 is viewed from the side of the machine.

FIG. 6 is viewed from the top of the machine.

DETAILED DESCRIPTION OF PREFERRED EMBODIMENT(S)

The following description illustrates by way of example and not by way of limitation.

Figure 1:
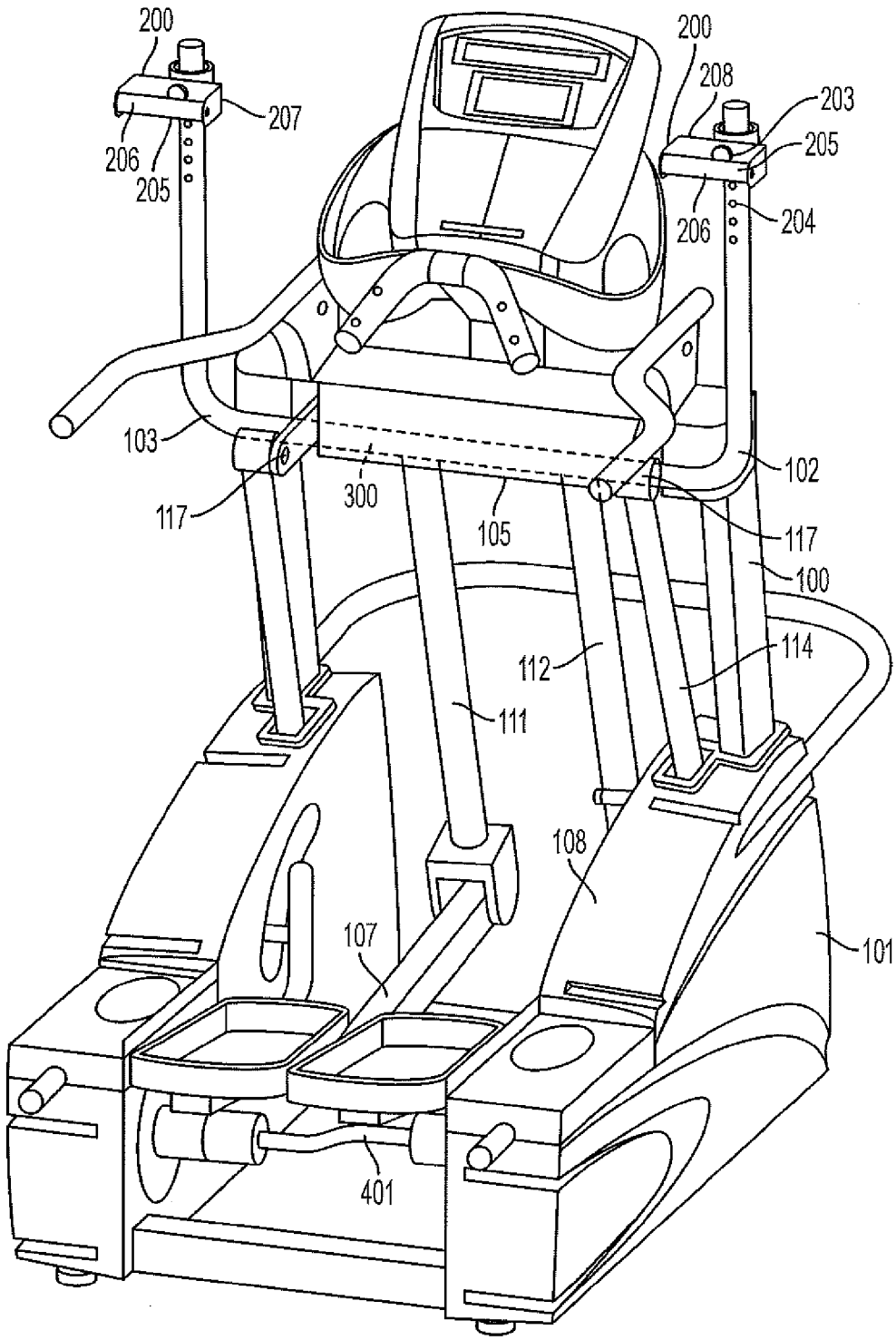
FIG. 1 provides a view of an embodiment of the rotatable handgrip as installed on one type of cardiovascular machine.

FIG. 1 shows a cardiovascular machine (100) outfitted with arms (102) and (103) moveable relative to the frame (101) that provide for upper body movement during cardiovascular exercise. In the figure, the arms (102) and (103) are interconnected or interlinked generally by a number of linkages. For example, linkages (111), (112), (113) and (114) visible in FIG. 1 to the foot pedals (401) for upper body pushing or pulling energy input or at least to synchronize their motion with movement of the footpads (401). The result is a generally fore and aft motion of the moveable arms (102) and (103) in a parallel plane fashion in planes generally parallel to the sides of a user of the cardiovascular machine. That is, the arms (102) and (103) provide for a standard aim pumping motion and if often performed by a user when walking or running to help maintain balance.

To each arm (102) and (103) is affixed a rotatable handgrip (200). In the depicted embodiment, the handgrips (200) are an extension of the arms (102) and (103), such that the handgrips (200) generally move and pivot together with the respective arms (102) and (103) to which they are attached in a back to front/front to back pivot stroke or travel path of motion. While FIG. 1 provides an embodiment with a rigid connection of the handgrips (200) to the arms (102) and (103), this disclosure contemplates that the handgrips (200) may be affixed to the arms (102) and (103) as any other handgrip (200) to a cardiovascular machine may be attached and may be designed to replace, instead of supplant, the upright portion of the arm (102) and (103) traditionally used as a grip. The handgrips (200) are generally different from other handgrips (200) affixed to the moveable arms (102) and (103) of cardiovascular machines by the fact that the handgrips (200) have a further rotatable component about an axis (2126) generally intersecting the handle (206) on the handgrip (200). In other words, the handgrips (200) give the user a means to comfortably rotate his or her arm around an axis generally parallel to and in time with the user's forearm, not just an axis perpendicular to the general direction of motion, such that the user's arm can engage in rotational motion from the user's shoulder to the user's wrists while exercising on the machine.

It is further understood by one of ordinary skill in the art that while FIG. 1 provides an embodiment of an arm (102) including a rotatable handgrip (200) affixed to an elliptical exercise machine, this disclosure contemplates embodiments of the rotatable handgrip (200) affixed to any cardiovascular machine (100), whether or not models currently exist that are outfitted with moveable arms. Similarly, while FIG. 2 provides an embodiment wherein the arms (102) and (103) of the cardiovascular machine move such that when a user is exercising on the machine, the arms (102) and (103) are moveable from a point in front of the user to a point generally close to the user in planes adjacent to the user's left and right sides, it would be commonly understood by one still in the art that this embodiment contemplates embodiments of the rotatable handgrip (200) affixed to arms (102) and (103) of cardiovascular machines that move in a variety of different ways.

In FIG. 1, the arms (102) and (103) of the cardiovascular machine are pivotably attached and interconnected to both the frame (101) of the cardiovascular machine (100) and ultimately to the motion of the foot pedals (401). The bottom of the arms (102) and (103), in the depicted embodiment, are attached to a linking shaft (300) within shoulder housing (105). The linking shaft (300) is then interlinked to the footpad rods (107) and (108) via the arm rods (111) and (112). The arms (102) and (103) also connect to linkages (113) and (114) via tilt bars (117). Linkages (113) and (114) with tilt bars (1007) can serve to import additional motion (either additive or subtractive) to the arms (102) and (103).

It should be recognized that while the arm operation of FIG. 1 is discussed above, the use of rotatable handles is not dependent on the operation of the arm motion and any mode of attachment of arms (102) and (103) to a cardiovascular machine (100) understood by one of ordinary skill in the art, whether interconnected or separate from the motion of the machine (100) in conjunction with a user's foot motion, is contemplated and while the embodiment shown in FIG. 1 is exemplary, it is by no means exhaustive of such connections. Still further in an alternative embodiment, the arms (102) and (103) are designed to move independently of the footpad (401) motion, or to be rigidly attached to the frame.

Figure 2:
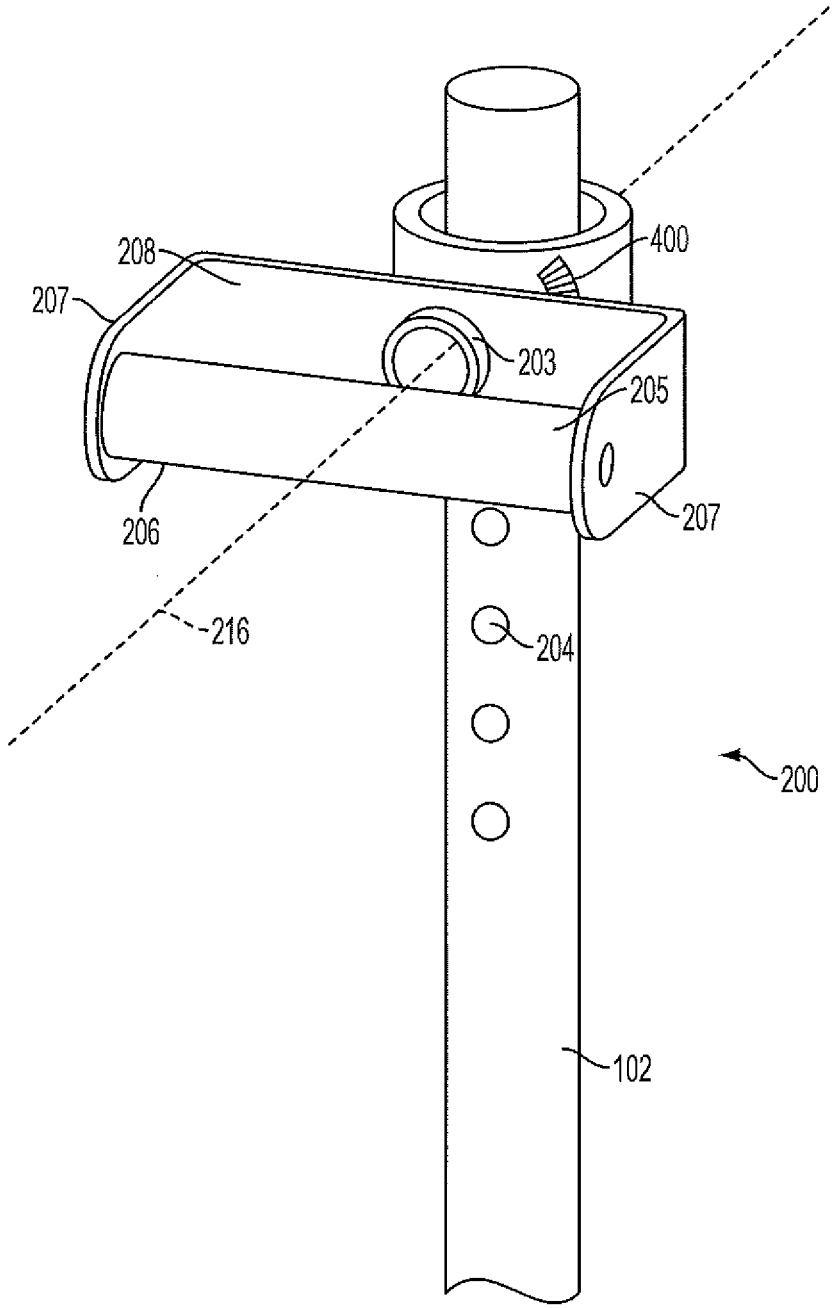
FIG. 2 provides a close-up view of an embodiment of the rotatable handgrip assembly.

FIG. 2 provides a closer view of an embodiment of a rotatable handgrip assembly of the embodiment of FIG. 1. In an embodiment, the rotatable handgrip assembly comprises the rotatable handgrip (200) and a portion of the arm (102) or (103) which is sometimes referred to herein as a shaft. The rotatable handgrip (200) then includes a pin (203) or similar structure interconnecting the rotatable handgrip (200) to the arm (102) or (103), a handle (205), and various pieces of support structure (207) and (208) for the handle (205). The handgrip (200) is generally connected to the arm (112) or (103) by the pin (203) at a height such that users may grasp the handle (205) and rotate the handle (205) about an axis (216) defined by the pin (203). The pin (213) could be at a number of different angles from the arms (102) and (103), or perpendicular to the moveable arms (102) and (103) as shown in FIG. 2.

FIG. 1 and FIG. 2 both show an embodiment of the shaft wherein the shaft is cylindrical in shape. A person skilled in the art however would recognize that in no way is this shape limiting, and that this disclosure contemplates embodiments of the shaft wherein the shaft is cubical, polygonal, or some other shape or form known by those skilled in the art so long as it provides for rotation of the handle (205) on the pin (203) and relative the arm (102) or (103).

In the embodiment shown in FIG. 2, the handgrip (200) comprises a back wall (208) abutting the arm (102), side portions (207), and a handle (205). The relationship between the back wall (208), side portions (207), and handle (205) may be at right angles, as in the depicted embodiment, or may be at any angular or curved relationship to each other. The back wall (208), side portions (207), and handle (205) themselves may also be curved, angular, or straight, as in the depicted embodiment, or any combination thereof. Generally, any shape and orientation of the back wall (208), side portions (207), and handle (205) is contemplated so long as the handle (205) is spaced from the back wall (208) and side portions (207) to permit the user's hand to encircle and grasp the handle (205). Moreover, the handle (205) may be a simple cylinder as in the depicted embodiment, or take any shape contemplated in the art, including but not limited to shapes that permit ergonomic grasping. In another embodiment, the handle (205) is covered with a non-slip or comfort covering (206) or other covering known to those skilled in the art.

Figure 4:
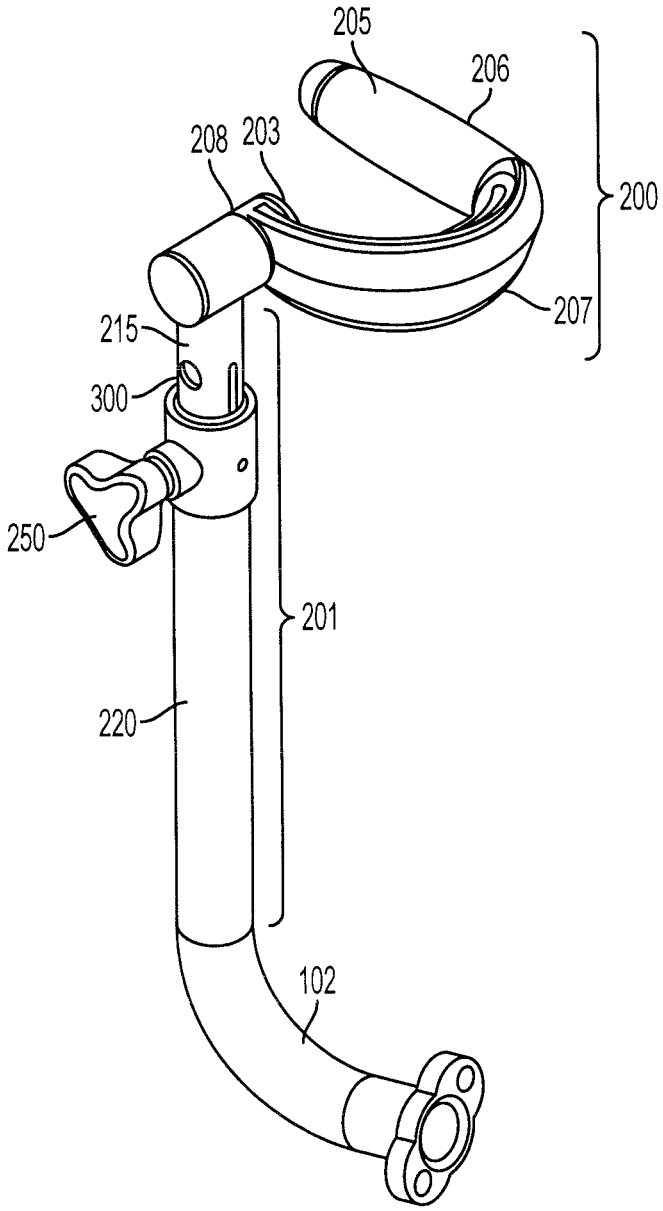
FIG. 4 provides a close-up view of another embodiment of the rotatable handgrip.

While the embodiment of the handgrip (200) in FIG. 1 shows a generally rectangularly shaped overall structure, one skilled in the art would recognize that this disclosure contemplates a plurality of differently shaped and structured handgrips (200), and one such alternative is shown in FIG. 4.

The pin (203) generally rotationally affixes the handle (205) to the arm (102), In the depicted pin embodiment (203), a pin (203) penetrates the back wall (208) of the handgrip (200) and lodges within a hole (204) on the arm (102) to secure the handle (205) to the arm (102). When pinned, the back wall (208) is essentially held to the arm (102) such that the back wall (208) generally does not slide along the length of the arm (102).

The pin assembly (203) permits the handle (205) to swing around the pin assembly (203) to carve a plane generally parallel to the line of the arm (102) and perpendicular to the axis of rotation (216). Accordingly, rotatability about the horizontal axis is possible due to rotation of the handle (205) about the pin (203). In the rotation of FIG. 2, the handgrip (200) pivots around an axis (216) generally in line with the center of a user's forearm. In other words, the handgrip's (200) axis of rotation both is in line with a user's forearm when grasping the handle (205) intersects generally with the user's fist, and intersects the arm (102) to which it is attached. One skilled in the art however would recognize that a pin (203) is not required and that this disclosure contemplates any mode of attachment of the handle (205) to the arm (201) that would allow the handle (205) to rotate about an axis (216) in a circular arc around the point of attachment, resulting in an axis of rotation that is both generally parallel to and in-line with a user's forearm and thus intersects the handle (205).

Due to the rotatable attachment, when a user grasping the handle (205) is moving the arms (102) and (103) of the cardiovascular machine (100) back and forth, the handle (205) can swing to accommodate the natural twisting of the user's wrists and forearms or to accommodate a user's purposefully twisting of their wrists, hands or arms during exercising. This rotatable movement allows a user to comfortably and easily rotate his or her arms in a horizontal axis generally parallel to and in line with their forearm bones (213) and (215) while exercising, thereby stretching and conditioning the muscles which provide rotary movement in addition to strengthening the user's arm and shoulder muscles. The result is an exercise machine which engages the user's arms through two general movements: 1) the fore and aft motion of the moveable arms which results in a generally arm pumping motion and 2) the rotation motion of the user's arms along a horizontal axis generally parallel to and in-line with their arm bones which results in a generally boxing-like or otherwise rotational motion as further described below.

Figure 3A:
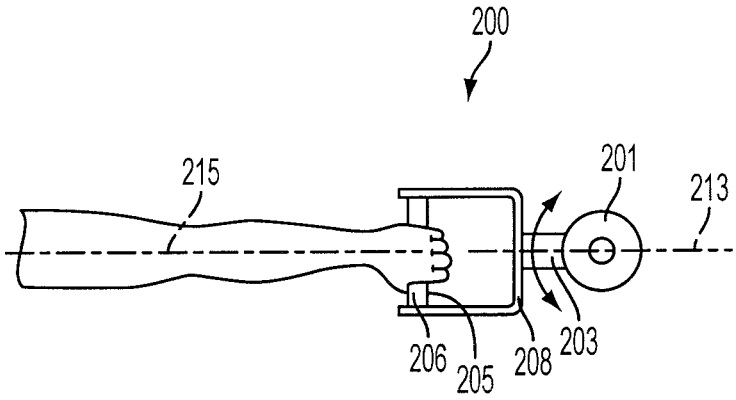
FIG. 3A provides a top view, and FIG. 3B provides a side view.
Figure 3B:
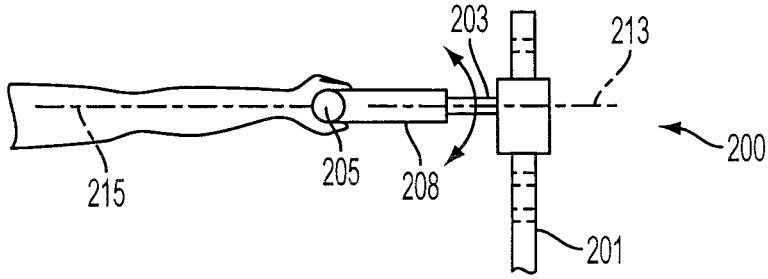
FIG. 3 provides two views of an embodiment of the rotatable handgrip being grasped by a human hand in a rotated position.
Figure 5:
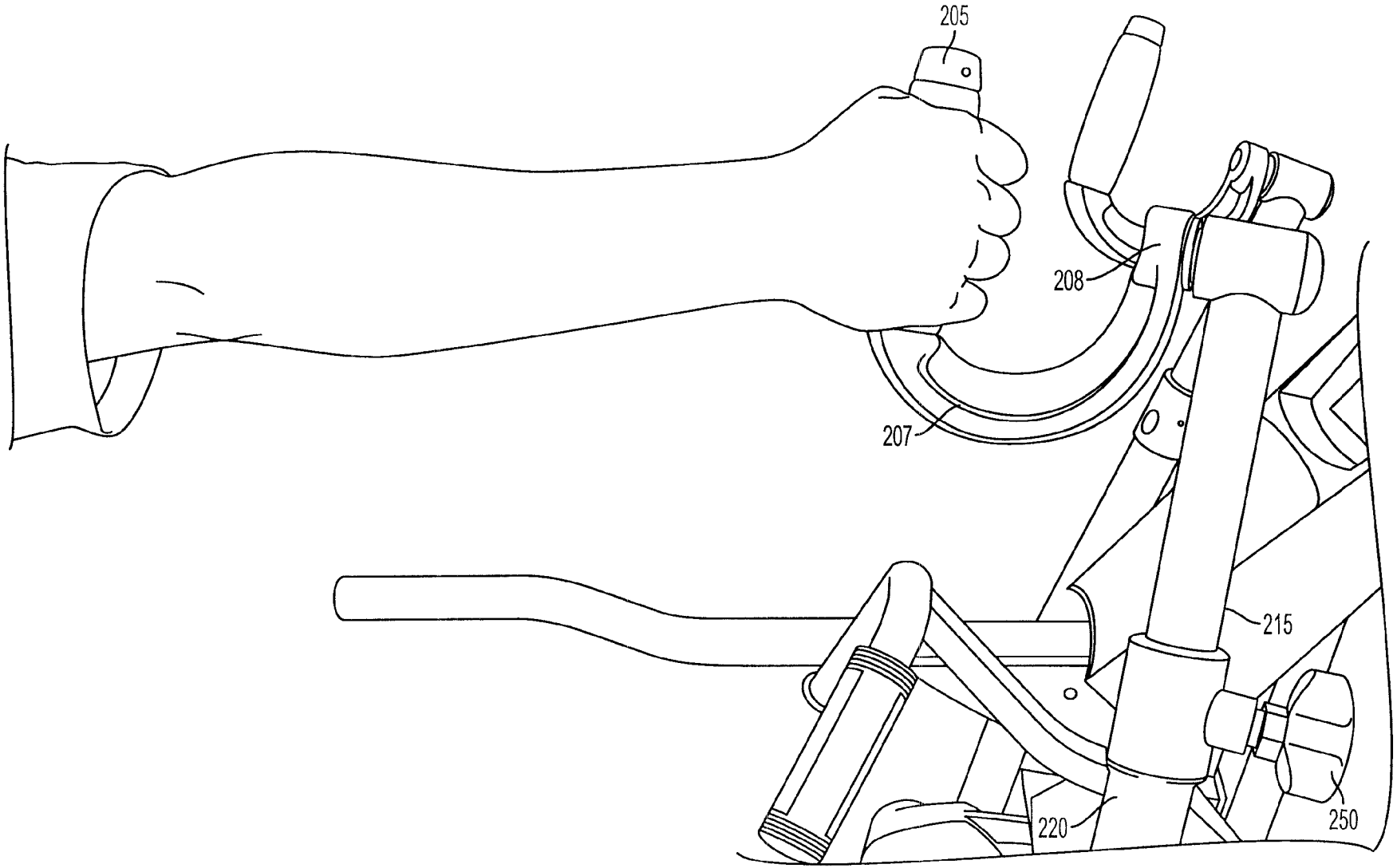
FIG. 5 provides an embodiment of a hand holding the handgrip of FIG. 4 with the hand in a generally upright position.
Figure 6:
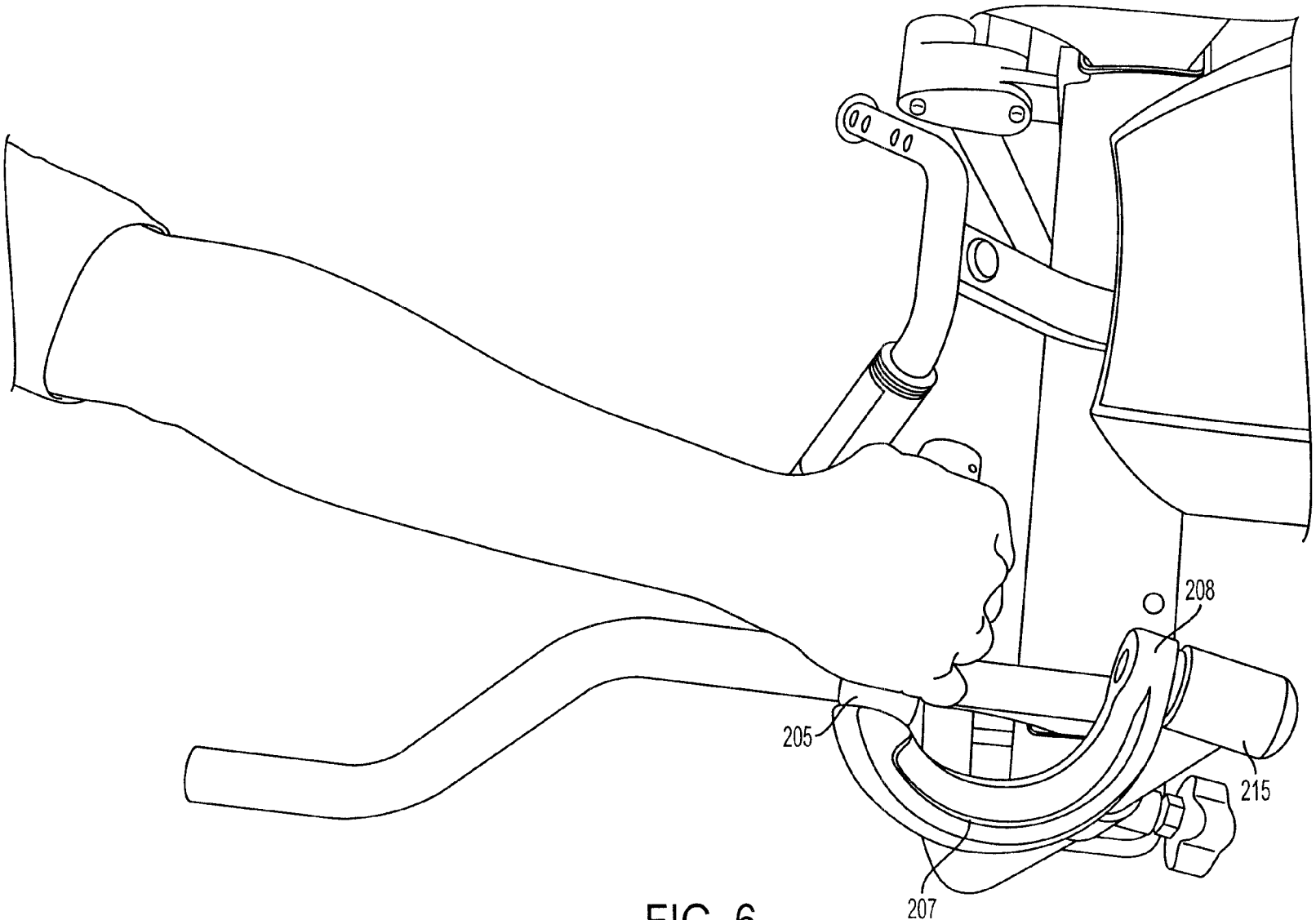
FIG. 6 provides an embodiment of a hand holding the handgrip of FIG. 4 in a 90 degree rotated position.

An embodiment of this swinging is illustrated in FIGS. 3A and 3B, in which the handle (205) pivots on the pin assembly (203) on axis (213) which is in line with the axis (215) of the user's wrist. Users of the rotatable handgrip (200) may thus engage in a generally boxing-like motion, rotating their wrists so that when an arm (102) or (103) is generally in front of the user, the user's knuckles face upward, whereas when an arm (102) or (103) is adjacent to or closer to the user, the user's thumb and medial portion of the user's first finger faces upward that is the first is held generally upright, as one would hold it when giving a "thumps-up" sign. FIGS. 5 and 6 show two further images illustrating the ability of the handgrip (201) to rotate This specific type of motion, while currently believed to be comfortable and enjoyable, is not the only type of motion which may be performed by rotating the handgrips and the user could reverse the rotation, or engage in other forms of rotation as desired. Further, the user's motion need not be consistent with each fore and aft motion of the arms (102) and (103) of the machine (100), but may change within an exercise.

This wrist and forearm rotation is permitted by the fact that the handle (205) can swivel around the pin assembly (203) to accommodate both sideways (FIGS. 4 and 6) and upright (FIG. 5) positions and all position therebetween. The alignment of axes (216) with the user's forearms makes the boxing motion ergonomic and comfortable, and diminishes the risk of injury and increases the user's enjoyment. This boxing-like motion is in no way required, however, as this disclosure contemplates any movement of the handle (205) in which the handle (205) is rotated in a plane generally perpendicular to the axis (216) such that the handle (205) rotates about an axis (216) that is both generally in line with user's forearm and intersects the handle (205). Such a motion could be counter-clockwise, or clockwise and in a variety of different angles of rotation recognized by an individual of ordinary skill in the art.

In another embodiment, shown in FIG. 4, the arm (102) is comprised of two tubes (215) and (220) which are telescopic relative to each other. In other words, the arm (102) is comprised of an inner tube (215) and an outer tube (220). The inner tube (215) slides or fits within the outer tube (220) rendering the length of the shaft (201), and accordingly the height of the handgrip (205), adjustable. The position of the inner tube (215) and the height of the handgrip (205) is secured by tightening the securing pin (250) into a hole (300) located on the inner tube (215). In other words, a user would adjust the height of the handgrip (205) by the following steps: unseating the securing pin (250); moving the handle (205) to the desired height for exercise; raising or lowering the inner tube (215); and reseating the securing pin (250) into the respective hole (300) that corresponds with the desired height. Other methods of securing the relative position of the two tubes (215) and (220) could also be used to adjust the height as would be understood by one of ordinary skill.

FIG. 4 also illustrates another embodiment of a handgrip (200) wherein the handgrip (200) comprises a back portion (208), a single side portion (207) and a handle (205) forming a generally "U" shape. In this embodiment, the side portion (207) is generally curved such that the general shape of the handle (205) is that of a "U". The grasping portion (206) is also elongated in this embodiment to allow for ease of grasping as shown in FIGS. 5 & 6. As stated previously, while FIG. 4 contemplates a generally "U" shaped handle, this disclosure contemplates any shaped handle known to those skilled in the art.

One benefit of the rotatable handle (205) disclosed herein as its ability to provide a user with a more intensive cardiovascular workout than traditional arms (102) and (103) that move in a fore and aft motion by engaging the user in additional movement, that is, the additional twisting and rotation of the user's forearm around a certain axis (213) and (215) from the user's shoulder to the user's wrist. In addition, the rotatable handle (205) eliminates the unnatural motion and awkward arm alignments typical of many cardiovascular machines.

In another embodiment, the handle (205) also provides a degree of resistance or friction against rotation to a user as opposed to being freely rotating. This friction or resistance increases the energy expended by the user in rotating the handle (205) and moving the arms (102) and (103), providing a more intense workout experience. This resistance assembly (400) for the handgrip (200) may include, but is not limited to, friction, air resistance devices, pneumatic or hydraulic devices, electromechanical devices or any combination thereof. This list is by no means exhaustive and represents only a few examples of resistance mechanisms that may be incorporated into the present invention. In another embodiment, the amount of friction or resistance on the handle (205) is adjustable by the user. This resistance component (400) will allow a user to experience muscle strengthening exercises for rotational muscles and cardiovascular conditioning due to the ability of the device to impart a desired degree of bias (i.e., tension). An example of one embodiment of an adjustable mechanical resistance mechanism (400) on the handgrip (200) is depicted in FIG. 2.

In another embodiment, the handle (205) of the handgrip (200) is mechanically or otherwise interconnectly rotated by the cardiovascular machine (100) or movement of the arms (102) and (103) such that the handle (205) automatically rotates in an arc dictated by the motion of the cardiovascular machine (100) generally by interconnecting the motion with that of the footpads (401). In this embodiment, a user who grasped the handle (205) would have his or her arms forced into a rotatable motion by the automative movement of the handle (205). In an embodiment, this automated motion can be adjusted by the user to control the degree and rate of rotation. Such motion can also utilize resistance used in the remaining exercise motion as desistance to such rotation, e.g., by using the user's twisting motion to help turn the crankshaft supporting the footpads (401) providing a more complete exercise.

In another embodiment, the handle (205) can move vertically up and down the length of the shaft (201) and still rotate in a plane generally parallel to the arm (102 or (103). This embodiment introduces an additional level of movement for the user, such that their arms can travel in three ways while grasping the handles (205) during exercise: the fore and aft motion dictated by the arms (102) and (103) of the cardiovascular machine, the rotational movement of the handle (205) in a circular axis about the pin assembly (203) and the vertical motion of the handle (205) as it ascends and descends along the length of the arm (102) or (103), Such vertical motion can also be separate from the exercise motion simply allowing for adjustment of the resistance of the handle (205) as shown in FIG. 2.

This boxing-like motion, with its rotational component, involves more movement by the user than the simple back-and-forth motion of current cardiovascular machine arms (102) and (103). Additional movement corresponds to a better user workout, burning more calories and utilizing more muscle groups. Users of the rotatable handgrip (200) may also be motivated to work out more aggressively than they would with conventional handgrips, due to the inherently aggressive nature of the boxing-like motion that the rotatable handgrip (200) affords. Finally, the rotatable handgrip (200) can better accommodate the natural rotation of the user's wrists and forearms, which increases the comfort of the user's upper body workout.

In the embodiment shown in FIGS. 1 and 2, the arms (102) and (103) present multiple holes (204) so that the handle (205) may be affixed to the shaft (201) at any one of multiple heights. This renders the rotatable handgrip (200) adjustable in height. Whereas users of current cardiovascular machine arms may grasp the arms at any comfortable height along the shaft without making any adjustment, the handle (205) disclosed herein may be grasped at only one height unless it is manually moved or includes vertical movement construction, as permitted by these embodiments. In other embodiments, it is contemplated that the handle (205) is not adjustably affixed to the shaft (201), but rather fixed permanently at a determined point along the shaft (201).

While an embodiment utilizing a pin assembly (203) with holes (204) is described herein, any other means known by one of ordinary skill in the art to affix the handle (205) to the shaft (201) such that the handle (205) may swing to carve a plane generally parallel to the line of the arm (102) or (103) is contemplated. In addition, such means for affixing may be such that a user causing the handle (205) to swing encounters some resistance.

In yet another embodiment, the handgrip (200) is not attached to rotatable arms (102) and (103) of a cardiovascular machine, but may be attached to non-moveable arms of a cardiovascular machine or any other part of the frame of a cardiovascular machine that a user could comfortably access with their arms while exercising to provide for rotational movement of the wrists, hands or arms.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention. Accordingly, it is intended that all reasonably foreseeable additions, modifications, deletions and alterations be included within the scope of the invention as defined in the following claims.

The invention claimed is:

1. A method of exercising a user's body on a cardiovascular exercise machine, the method comprising:

providing an exercise machine having:

a frame at least two footpads;

at least two arms, each of said arms having a longitudinal axis and being interlinked to the motion of one of said footpads via at least one linkage when said machine is in motion; and a handle rotatably attached to each of said arms at a point of attachment having a rotatable component of motion about an axis intersecting said longitudinal axis at said point of attachment;

grasping said handles rotatably attached to said arms of said cardiovascular exercise machine;

inserting said user's feet on said footpads of said cardiovascular exercise machine and moving said footpads in a back and forth motion;

moving said arms of said cardiovascular exercise machine in a back and forth motion in a plane parallel to said user's left and right sides and in a movement interlinked to the movement of said footpads via said linkage;

rotating each of said handles relative to said arm around an axis generally parallel to said user's forearm and perpendicular to said axis at said point of attachment and rotating said handles during the back and forth motion of said arms and said footpads;

wherein the movement of said footpads, arms and said handles are interrelated movements during said cardiovascular exercise.

2. A cardiovascular exercise machine comprising:

a frame at least two footpads;

at least two arms, each of said arms having a longitudinal axis and being interlinked to the motion of one of said footpads via at least one linkage when said machine is in motion; and a handle rotatably attached to each of said arms at a point of attachment having a rotatable component of motion about an axis intersecting said longitudinal axis at said point of attachment;

wherein said footpads, move in a fore and aft motion relative to said cardiovascular machine;

wherein said arms move in a fore and aft motion in a plane parallel to a user's left and right sides and in a movement interlinked to the movement of said footpads via said linkage;

wherein each of said handles rotates in a circular arc about said axis at said point of attachment; and wherein each of said arms, said footpads and said rotatably attached handles move during said user's cardiovascular exercise on said machine such that said user's arms can move in a rotational component of motion with said handles and a fore and aft component of motion with said arms during exercise.

3. The rotatable handgrip of claim 2 wherein said handle is adjustably affixed to said arm.

4. The rotatable handgrip of claim 2 wherein said handle is located at a functional location relative to a user of said cardiovascular exercise machine.

5. The rotatable handgrip of claim 2 wherein rotation of said handle encounters resistance.

6. The rotatable handgrip of claim 2 wherein each said arm comprises an inner tube with holes, an outer tube, and a securing pin interconnecting said inner tube and said outer tube such that the height of said handle can be adjusted via the telescoping capabilities of said inner tube relative to aid outer tube.

7. The rotatable handgrip of claim 2 wherein said handgrip further comprises:

a back wall; and a side portion;

wherein said back wall is rotatably affixed to said arm via said pin.

8. The rotatable handgrip of claim 7 wherein said pin penetrates said back wall of said handgrip and lodges within a hole on said arm to secure said handle to said arm.

9. The rotatable handgrip of claim 8 wherein said arm has a plurality of holes such that said handle may be affixed to said arm at any one of multiple heights.

10. The rotatable handgrip of claim 9 wherein said handle swings around said pin to accommodate the natural twisting of said user's wrists.

11. The method of claim 1 further comprising moving said handles vertically up and down a shaft of said arms while rotating said handles in a plane generally parallel to said arms.

12. The cardiovascular exercise machine of claim 2 wherein each of said handles can move vertically up and down the length of a shaft of said arm while rotating relative to the attached arm.

* * * * *